US010718191B2

(12) United States Patent
Kravets et al.

(10) Patent No.: US 10,718,191 B2
(45) Date of Patent: Jul. 21, 2020

(54) METHOD FOR ENHANCING HYDROCARBON PRODUCTION FROM UNCONVENTIONAL SHALE RESERVOIRS

(71) Applicant: University of Louisiana at Lafayette, Lafayette, LA (US)

(72) Inventors: Joseph Kravets, Staten Island, NY (US); Rustam Nizamutdinov, Houston, TX (US); Asadollah Hayatdavoudi, San Ramon, CA (US)

(73) Assignee: University of Louisana at Lafayette, Lafayette, LA (US)

( * ) Notice: Subject to any disclaimer, the term of this patent is extended or adjusted under 35 U.S.C. 154(b) by 0 days.

(21) Appl. No.: 15/191,984

(22) Filed: Jun. 24, 2016

(65) Prior Publication Data

US 2017/0022793 A1 Jan. 26, 2017

Related U.S. Application Data

(60) Provisional application No. 62/184,965, filed on Jun. 26, 2015.

(51) Int. Cl.
*E21B 43/24* (2006.01)
*E21B 43/26* (2006.01)

(52) U.S. Cl.
CPC ..... *E21B 43/2405* (2013.01); *E21B 43/26* (2013.01)

(58) Field of Classification Search
CPC ..... E21B 43/003; E21B 28/00; E21B 43/24; E21B 43/2405; E21B 43/2408; E21B 43/2406
See application file for complete search history.

(56) References Cited

U.S. PATENT DOCUMENTS 2,184,809 A * 12/1939 Brammer ..... E21B 43/003 166/177.6
3,327,527 A * 6/1967 Arps ..... E21B 47/065 73/152.03
5,460,223 A * 10/1995 Economides ..... E21B 43/003 166/177.1
2003/0042018 A1* 3/2003 Huh ..... E21B 43/003 166/249
2005/0072567 A1* 4/2005 Steele ..... E21B 43/2406 166/272.3
2010/0000733 A1* 1/2010 Chiesa ..... E21B 43/24 166/272.6
2010/0288497 A1* 11/2010 Burnham ..... E21B 43/24 166/303
2012/0132416 A1* 5/2012 Zolezzi-Garreton ... E21B 28/00 166/249
2015/0144347 A1* 5/2015 Brannon ..... E21B 43/261 166/308.1
2015/0204170 A1* 7/2015 Ayan ..... E21B 43/25 166/250.01

(Continued)

*Primary Examiner* — Kipp C Wallace
(74) *Attorney, Agent, or Firm* — Russel O. Primeaux; Jessica C. Engler; Kean Miller LLP

(57) ABSTRACT

The inventive method provides a mechanism for enhancing oil and gas production in shale wells in order to prevent re-Fracking of the wells. The invention discloses the effect that temperature has on creating micro-fractures in the shale and offers opportunities to apply temperature in a way that increases seismic activity, including through the application of low quality steam or by heating the fracturing fluid.

4 Claims, 13 Drawing Sheets

(56) References Cited

U.S. PATENT DOCUMENTS

2015/0285051 A1* 10/2015 Miller ..... E21B 43/2408
166/272.3
2017/0247992 A1* 8/2017 Parrella ..... E21B 43/24

* cited by examiner

FIGURE 8

| Section | Time interval, sec | Diffusion Coefficient, D | | | Rate Constant, K, $L.mol^{-1}s^{-1}g^{-1}$ | Reaction Rate, $R_r$,[mol. $L^{-1}s^{-1}g^{-1}$] |
|---|---|---|---|---|---|---|
| | | $mm^2s^{-1}g^{-1}$ | $m^2s^{-1}g^{-1}$ | $ft^2s^{-1}g^{-1}$ | | |
| 1 | 0–489 | N/A | N/A | N/A | N/A | N/A |
| 2 | 489–999 | 0.006374 | 6.37E-09 | 6.86E-08 | 76.6661 | 3.719E-05 |
| 3 | 999–1995 | 0.000227 | 2.27E-10 | 2.44E-09 | 92.4144 | 8.619E-05 |
| 4 | 1995–2523 | 2.37E-05 | 2.37E-11 | 2.55E-10 | 120.0690 | 1.664E-04 |
| 5 | 2523-3069 | 1.79E-05 | 1.79E-11 | 1.93E-10 | 129.6858 | 2.170E-04 |

FIGURE 9

| Section | Time interval, sec | Diffusion Coefficient, D | | | Rate Constant, K, $L.mol^{-1}s^{-1}g^{-1}$ | Reaction Rate, $R_r$,[mol. $L^{-1}s^{-1}g^{-1}$] |
|---|---|---|---|---|---|---|
| | | $mm^{2}s^{-1}g^{-1}$ | | | | |
| 1 | 0 – 225 | N/A | N/A | N/A | N/A | N/A |
| 2 | 225 – 723 | 0.820 | 8.20E-07 | 8.83E-06 | 108.0146 | 3.537E-06 |
| 3 | 723 – 1146 | 0.057 | 5.73E-08 | 6.17E-07 | 214.3877 | 5.602E-06 |
| 4 | 1146 – 1500 | 0.016 | 1.65E-08 | 1.77E-07 | 454.8013 | 4.148E-05 |
| 5 | 1500 – 1866 | 0.004 | 4.27E-09 | 4.59E-08 | 1798.7372 | 2.032E-04 |
| 6 | 1866 – 2445 | 0.001 | 1.74E-09 | 1.87E-08 | 3415.3654 | 4.891E-04 |
| 7 | 2448 – 3069 | 0.0003 | 3.30E-10 | 3.55E-09 | 4480.5459 | 1.170E-03 |

METHOD FOR ENHANCING HYDROCARBON PRODUCTION FROM UNCONVENTIONAL SHALE RESERVOIRS

This application claims the benefit of U.S. Provisional Patent Application No. 62/184,965 filed on Jun. 26, 2015. The disclosure of the referenced application is hereby incorporated herein in its entirety by reference.

The present invention relates to the field of shale gas well recovery and sustaining production from the Fracking process, particularly the use of steam and heat to enhance hydrocarbon production during shale recovery.

BACKGROUND OF THE INVENTION

Novel oilfield technologies such as horizontal drilling and hydraulic fracturing have allowed producers to generate a tremendous amount of hydrocarbon from tight, ultra-low permeability source rock such as shale and similar formations. The process of fracking involves the high-pressure injection of fracking fluid into a wellbore to create cracks in the deep rock formations through which natural gas, petroleum, and brine will flow more freely. More often than not, the wells begin producing immediately after fracking. At the beginning of a well's production, there is a period of high production rate, also known as "flash production." Thereafter, oil and gas production levels fall off rapidly. The short life spans of the wells are one of the greatest weaknesses of the fracking process. In order to stretch the lifespan of these wells, operators are re-Fracking the wells one or multiple times to re-stimulate the well. The re-fracking process is often uneconomical and is environmentally unacceptable in certain locations.

A potential alternative to rapid production decline was recently suggested when an operator was required to shut-in a well for approximately three month after fracking until the pipeline became available to transport the hydrocarbons to the market. During shut in, while waiting for the pipeline in the post-fracking period, the operators continued to monitor the seismic activities to the well. The operators observed that the well was still showing signs of seismic activities such as extensions of the micro-fractures in the rock. After the flow-back of the fracturing fluid, the operators further discovered that the production decline behavior of the wells put on production without delays after the flow-back were comparable to the well that endured three months of delay. Additionally, the production of hydrocarbons form the well had improved drastically. However, the cause of this effect has not yet been explored. There is a need in the market to be able to stimulate this effect in wells in order to enhance hydrocarbon production without the need for additional fracking.

SUMMARY OF THE INVENTION

The disclosed invention provides a method for enhancing shale oil and gas recovery in wells during the fracking process. As disclosed herein, the method uses heat and temperature changes to treat the shale to increase the number and extent of micro-fractures within the shale, which increases seismic activity and oil and gas production. This method provides a more environmentally conscious alternative to re-fracking wells multiple times. This invention can be used to stimulate the shale gas oil wells by introducing low quality steam into the well and using hammering devices to generate low non-damaging amplitude and non-damaging frequency to heat and cool the formation behind a casing. The process opens existing micro-fractures, when and if they are closed, and generate new micro-fractures in three dimensions in previously thermally logged holes that are considered potential zones of geothermal activity.

In practicing this method, the inventor will perform a thermal survey of the well using known methods in the art to determine thermal conductivity and heat transfer. The thermal survey can be conducted during drilling or post-drilling. The user then marks of the ideal zones in the well that indicate the presence of a geothermal system by using known thermal conductivity measuring devices in order to locate the high and low regions of thermal conductivity or materials encountered by the drill bit. These zones are potential zones or stages for heating or cooling of the formation to a predetermined temperature for initiating the micro-fractures prior to the hydraulic fracturing. The thermal survey can assist in delimiting the areas of enhanced thermal gradient and define temperature distribution.

Next, the user generates a heat spectrum of each potential zone. This step includes obtaining the optimal frequency of each identified zone. For shale, that optimal frequency will be at a point less than 900 Hertz. That optimal frequency than then be inputted into a programmable logic controller that will control the quality and generation of heat and/or steam in the system. Methods for writing the control logic to measure steam quality and generation of steam are known in the art. The controller will detect the ambient temperature of the ideal zones in the well, and will generate steam to that zone that is slightly increased above the ambient temperature. The controller will measure the temperature of the zone, exposure time, and frequency of the zone in order to maintain the optimum frequency in the zone and prevent total failure of the shale.

BRIEF DESCRIPTION OF THE DRAWINGS

FIG. 2 is an example of how temperature and relative humidity may vary with the time of exposure.

FIG. 8 is a table showing a summary of the diffusion coefficient (D), reaction rate constant (k), and reaction rate (R) of each section of an experimental specimen at the ambient temperature seen in FIG. 6.

FIG. 9 is a table showing a summary of the diffusion coefficient (D), reaction rate constant (k), and reaction rate (R) of each section of an experimental specimen performed at 10 degrees above the initial ambient temperature, or the temperature used in FIG. 7.

DETAILED DESCRIPTION OF THE INVENTION

Figure 1:
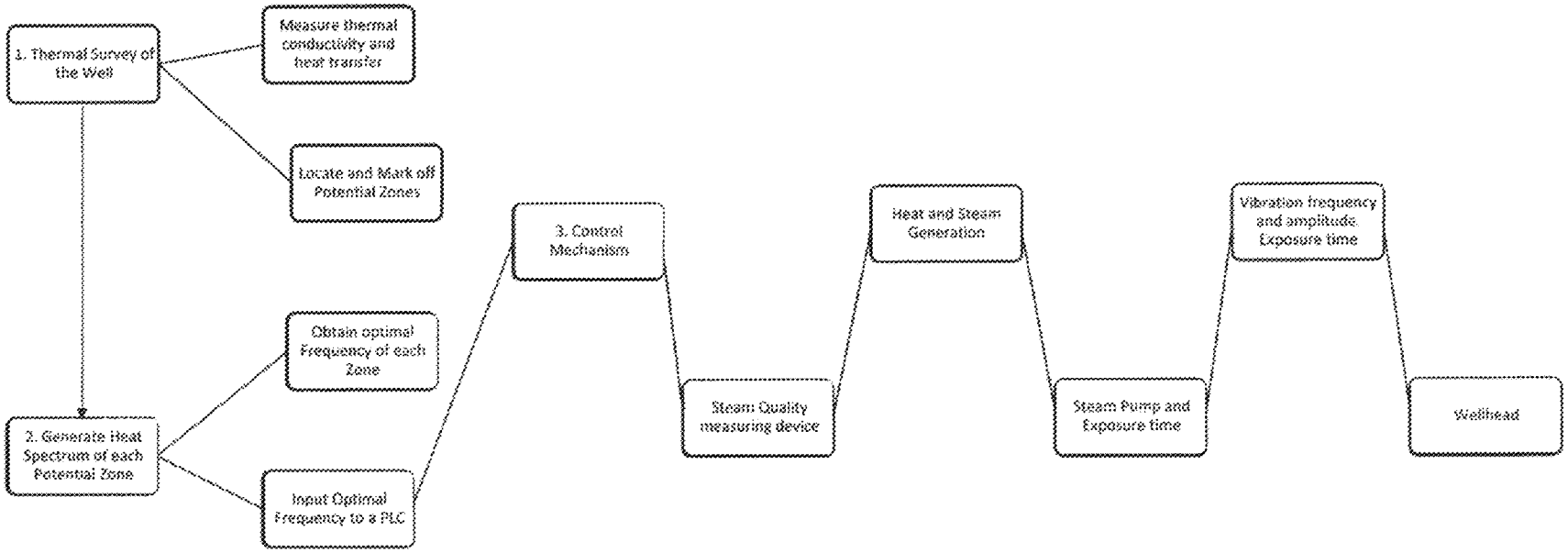
FIG. 1 depicts a schematic of the basic field operation of this method in practice. Each component can take various forms to generate the optimal number of micro-fractures in the systems under heat and cyclic steam pressure.
Figure 2:
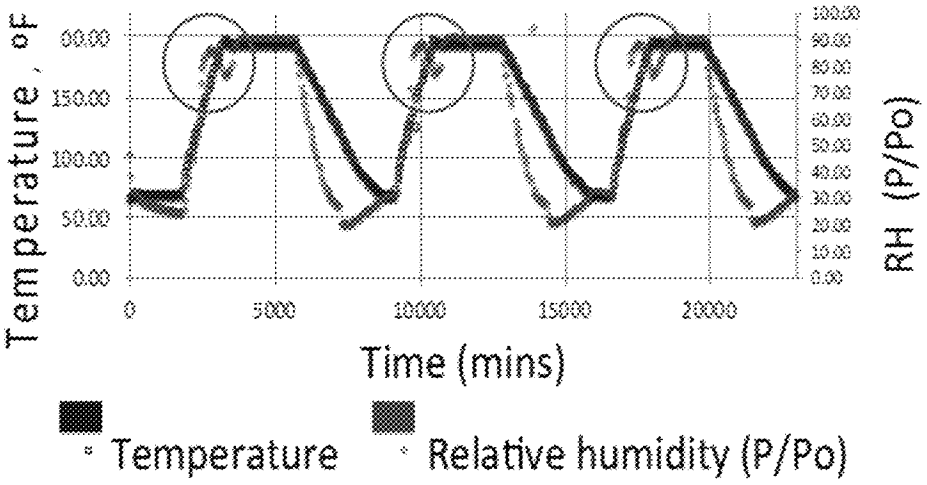
FIG. 2 provides a sample regime of cycling temperature and relative humidity in an environmental chamber.
Figure 3:
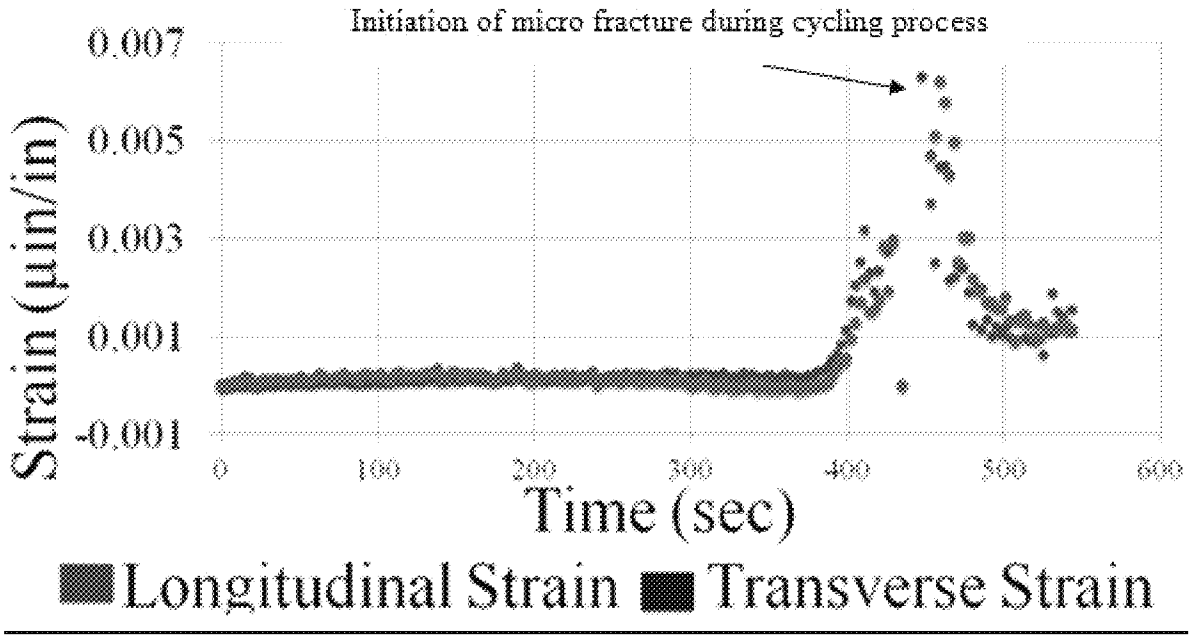
FIG. 3 is a graph of strain buildup over time during the first cycle and initiation of micro-fractures in tight shale reservoirs.
Figure 4:
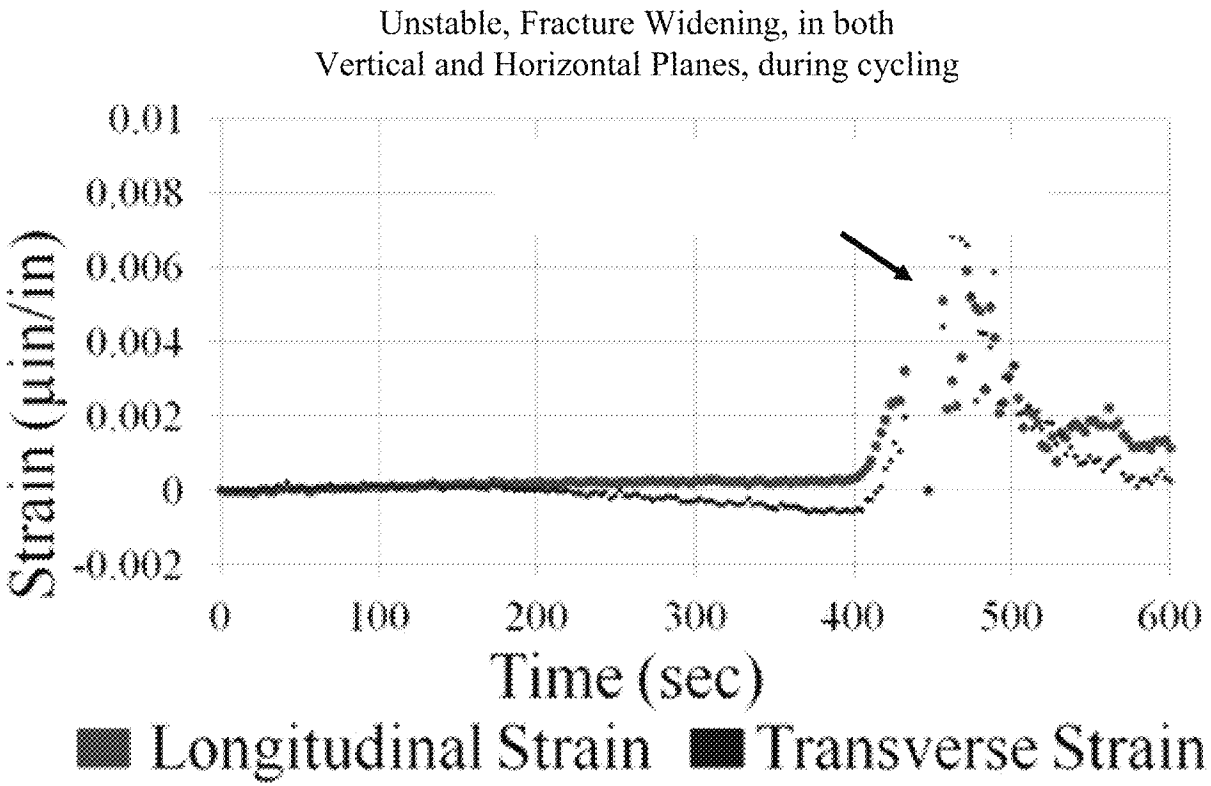
FIG. 4 is a graph of strain buildup over time during the second cycle and separation of strain patterns that indicate fracture widening and propagation in tight shale reservoirs.
Figure 5:
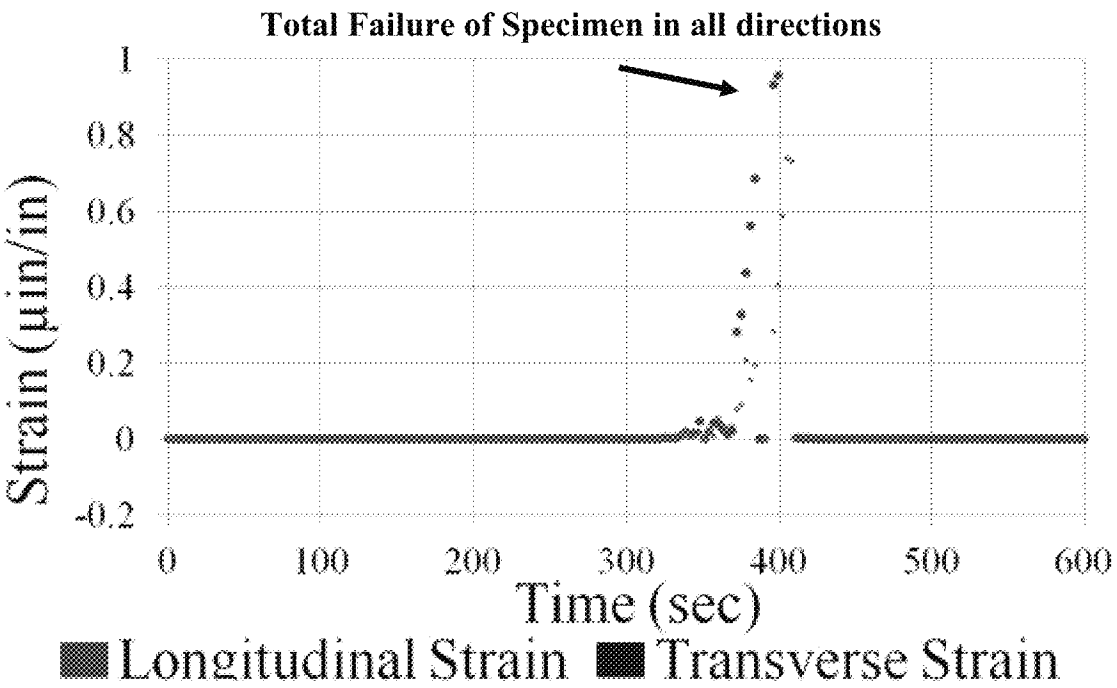
FIG. 5 is a graph of strain buildup over time during the third cycle and total failure of the shale.

The disclosed method is a method for enhancing hydrocarbon production in shale wells by optimizing the necessary post-Fracking shut-in time and improving the decline rate, consequently minimizing the need for re-Fracking.

The reaction of water with shale follows a "two mode reaction" The first reaction occurs early in the process when the hydraulic potential is the dominant mode. This mode is analogous to pumping the Fracking fluid at high pressures to fracture the tight, shale formations. Afterwards, there occurs a roll-over from the hydraulic potential to the second mode of reaction.

The second mode of reaction follows what is known in the art as Fick's Second Law of Diffusivity:

$$\frac{\partial C}{\partial t} = D\frac{\partial^2 C}{\partial x^2}$$

$$\frac{\partial Eh}{\partial t} = \frac{-\partial C(x, t)}{\partial x},$$

And, by assuming that the solution to the above Equation can be obtained in the form of the following (hereinafter "Equation 1"):

$$\left[\frac{E_{ho} - E_h(x, t)}{E_{ho} - E_{hs}}\right] = 1 - \mathrm{erf}[Z]$$

The parameters in the left hand side of Equation 1 can be measured from the boundary conditions $E_{ho}$ (at the end of the record at equilibrium), $E_S$ (the surface potential at the end of hydraulic potential) and $E_{h(x,t)}$ (at any desired distance and time). This enables the user to calculate the erf [Z], which is known to those having skill in the art to be the error function encountered in integrating the normal distribution. The Z value can be pulled from the widely-available and known Table of erf [Z] or the user can calculate Z through interpolation. Substituting the Z value into the below equation (hereinafter "Equation 2") and at a predetermined distance to which the user wants the micro-fractures to extend to, and having the value of D (the diffusion coefficient calculated from the slope of Eh plot or at any desired point in time or frequency), the user is able to determine the optimal shut in time to enhance hydrocarbon production, rather than relying on the imprecise accidental post-Fracking shut-in time:

$$Z = \frac{x}{(4Dt)^{0.5}}$$

The shale capillary activation where diffusion potential dominates show that the reaction of the water with shale follows a modified definition and form of the Arrhenius Equation as shown below:

$$k = \left[A \cdot e^{\frac{-E_h}{RT}}\right] \times \frac{1}{C_{Na^+}}$$

Upon entry of water molecules into the shale small pore spaces, the ionization of absorbed metal atoms begins. For example, when sodium ion ($Na^+$) desorbs from the clay fraction of shale and enters the surrounding water, the capillaries are activated, micro-fractures develop, and the gas production follows within a very short time. This ionization is not limited to alkali metal elements but also to radicals including but not limited to bicarbonate ($HCO^-_3$).

When the presence of the sodium ion in surrounding water is detected by an electrode, the displacement of the first gas bubble from shale occurs. The time from t=0 of the measurement recording when water contacts the shale to the release of the first bubble from the sale mass is equal to the estimates of the modified Arrhenius Equation's Prefactor "A" above. The other variables in the modified Arrhenius Equation include: k (reaction rate constant), A (frequency factor or Prefactor, which is a measure of collision of molecules displacing each other—such as water molecules displacing gas bubbles from the micro-capillary walls), $E_h$ (capillary activation energy in millivolts), R (universal gas constant, 8.314 J $mol^{-1}$ $K^{-1}$), C (concentration of any ion in the solution calculated from the Eh measurement of an ion specific electrode), and T (temperature in degrees Kelvin). In experimentation, the frequency factor was equal to A=(1/t) with t being in seconds, being the video camera time measured from the start of water contacting the shale mass to the time the first bubble released from the shale was observed.

Figure 6:
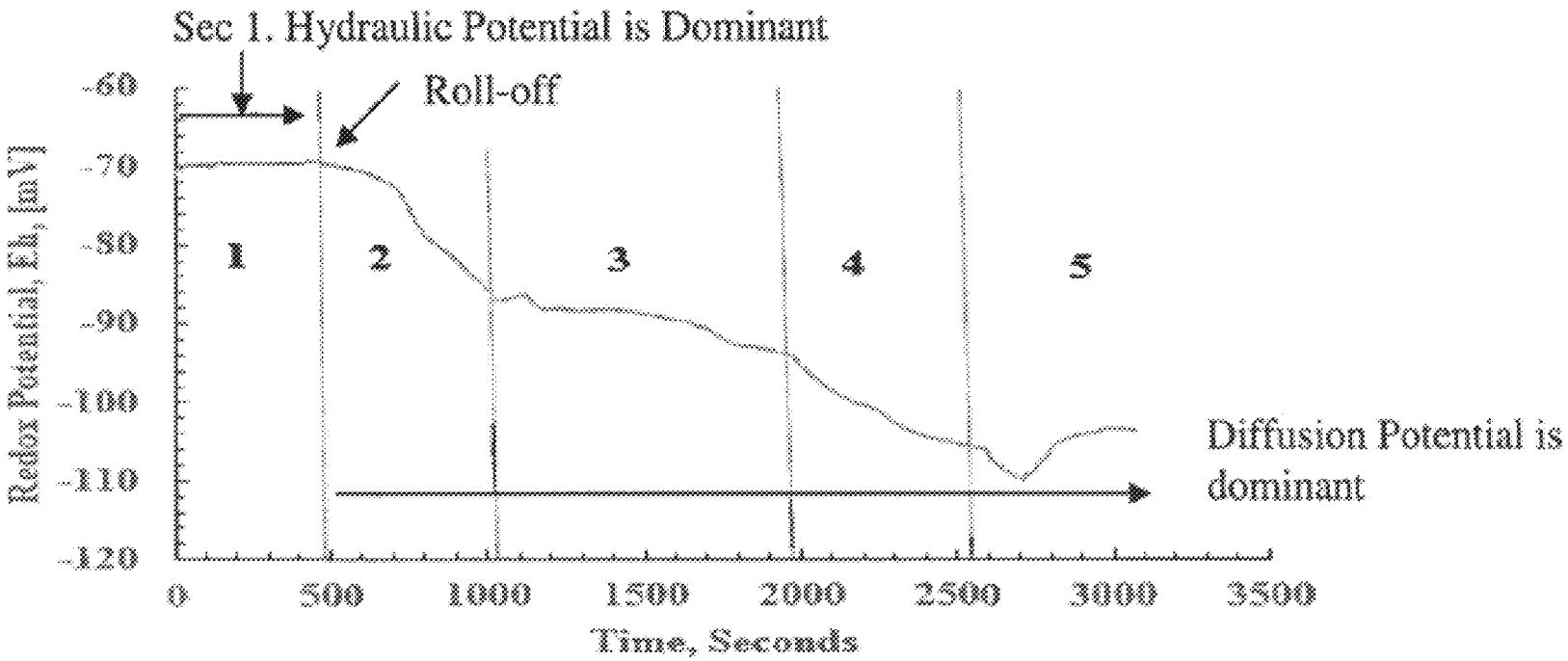
FIG. 6 is a graph demonstrating the redox potential raw data for fracturing fluid at ambient temperature.
Figure 7:
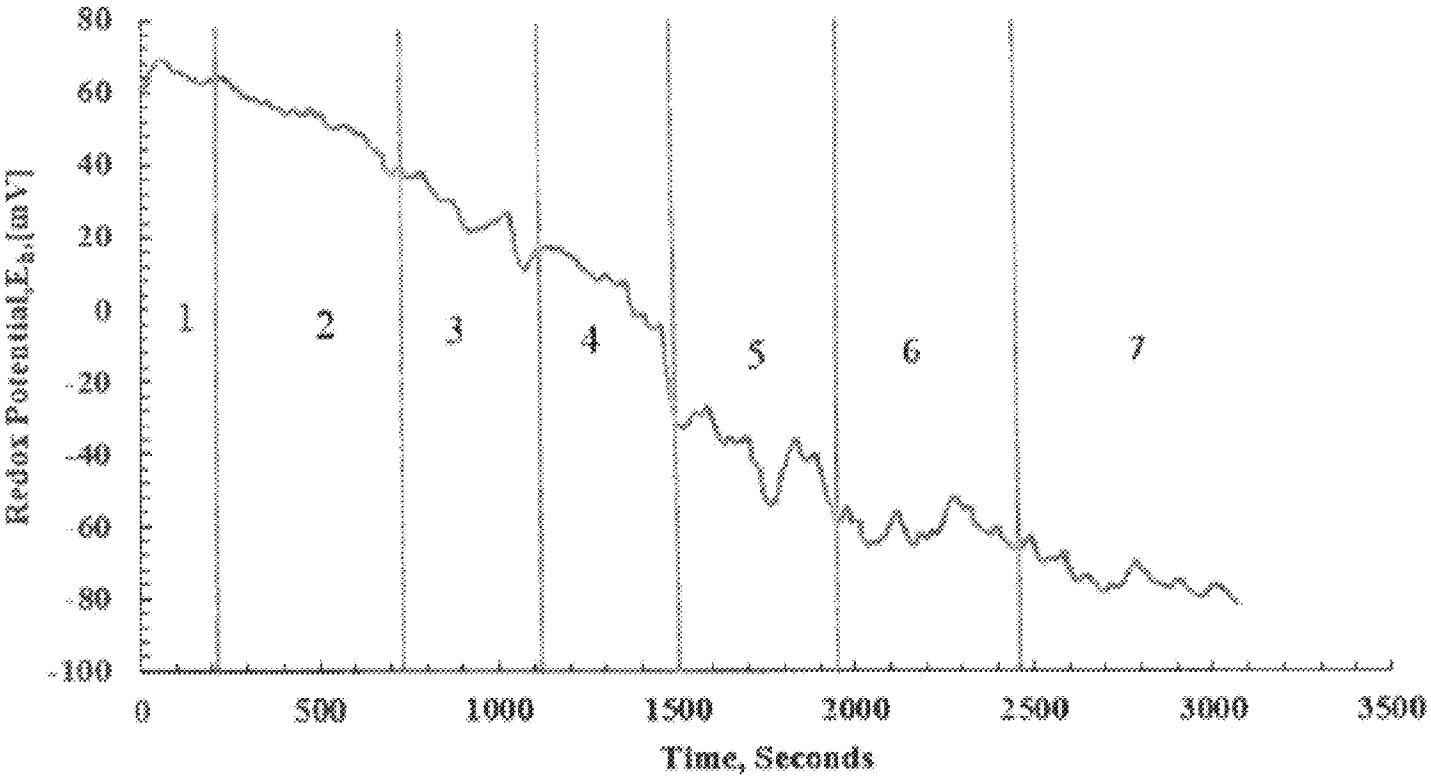
FIG. 7 is a graph demonstrating the redox potential raw data for fracturing fluid at 10 degrees above the initial ambient temperature seen in FIG. 6.
Figure 10:
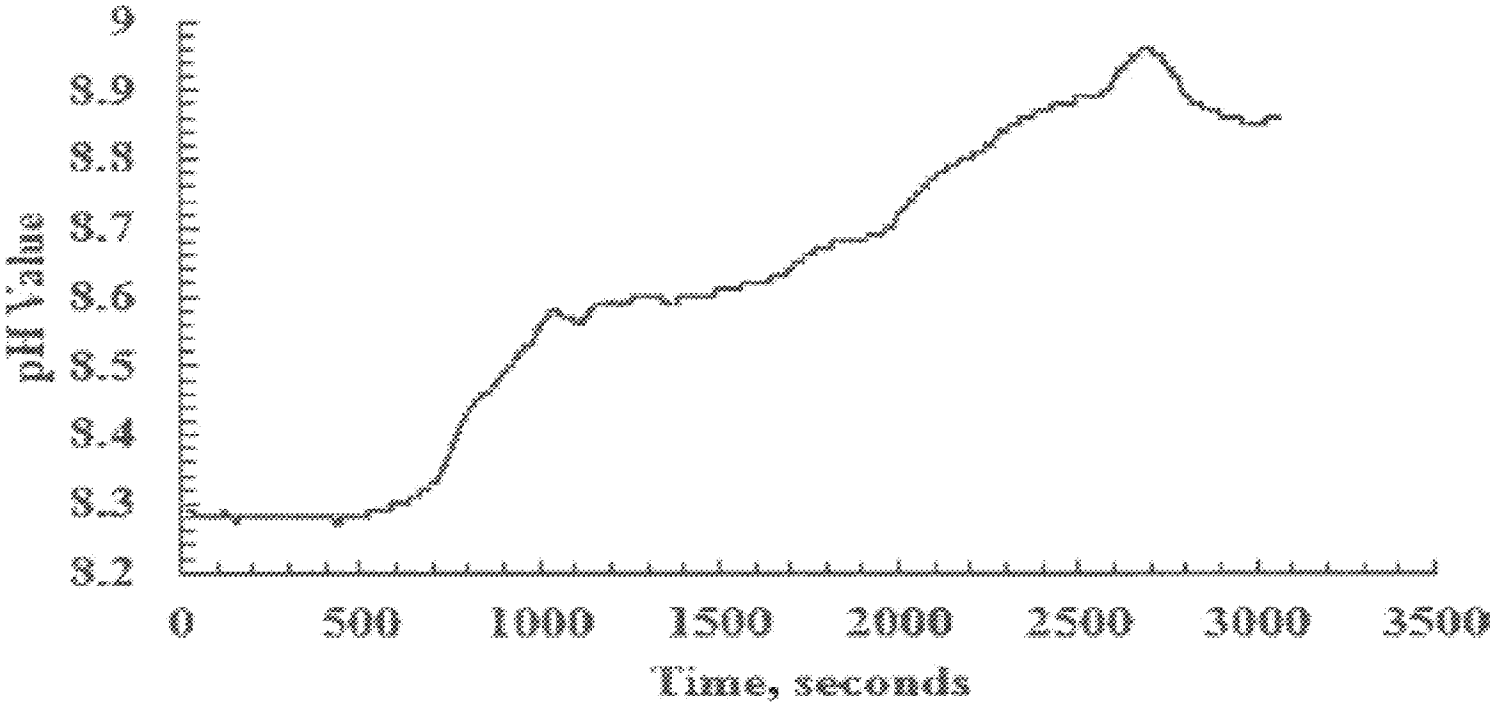
FIG. 10 is a graph of the pH value of the cold fracturing fluid at ambient temperature over time.
Figure 11:
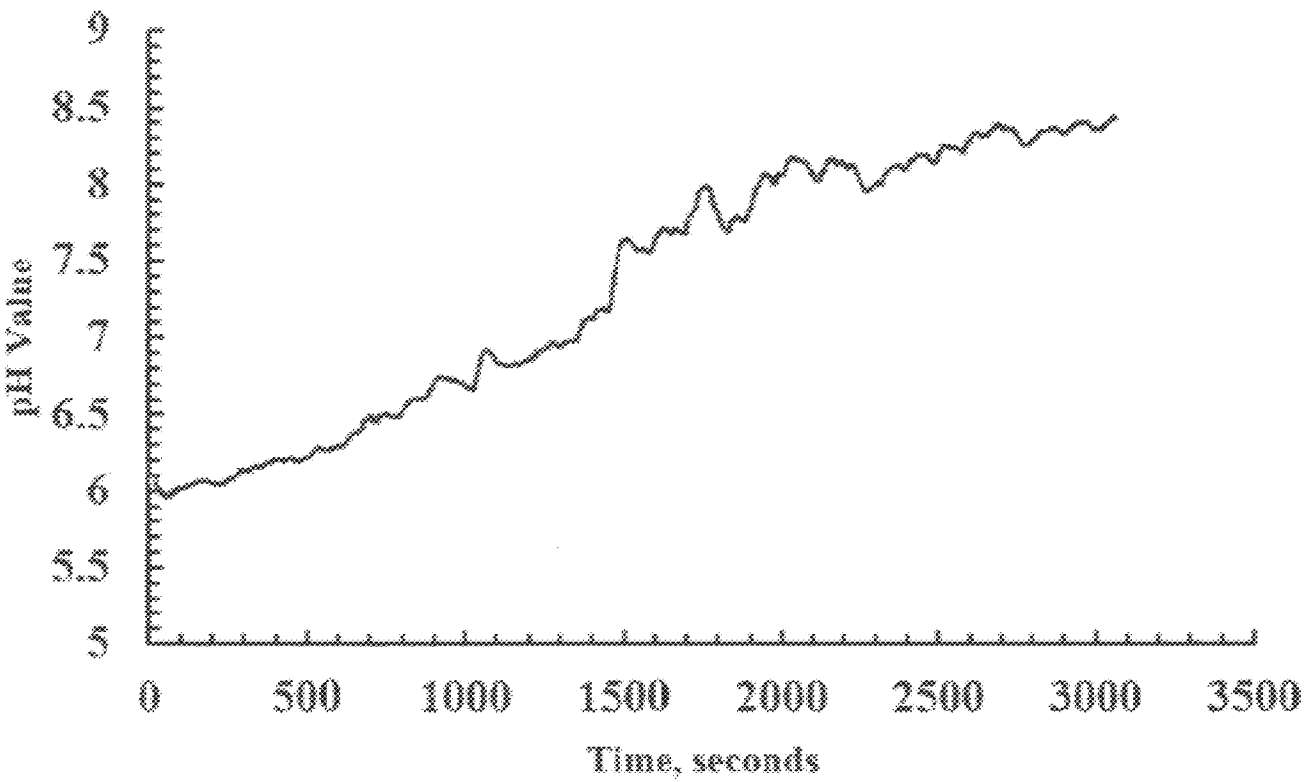
FIG. 11 is a graph of the pH value for the heated fracturing fluid.

When heat is applied to the fluid approximately 10 degrees above the reservoir temperature, the reaction parameters of the modified Arrhenius Equation and the reaction rate become faster. In addition, the Fick's diffusion constant D in Fick's Second Law of Diffusivity and Equation 2 becomes faster. By energizing the Fracking fluid by small amounts from the base temperature of the reservoir, the process of creating micro-fractures can be expedited. Consequently, the optimal post-Fracking shut-in time can be shortened, and operators can realize a higher and improved production rate. The evidence for this improved production rate can be shown by comparing the redox potentials seen in FIGS. 6 and 7, the variables seen in FIGS. 8 and 9, and the pH values in FIGS. 10 and 11.

Figure 12:
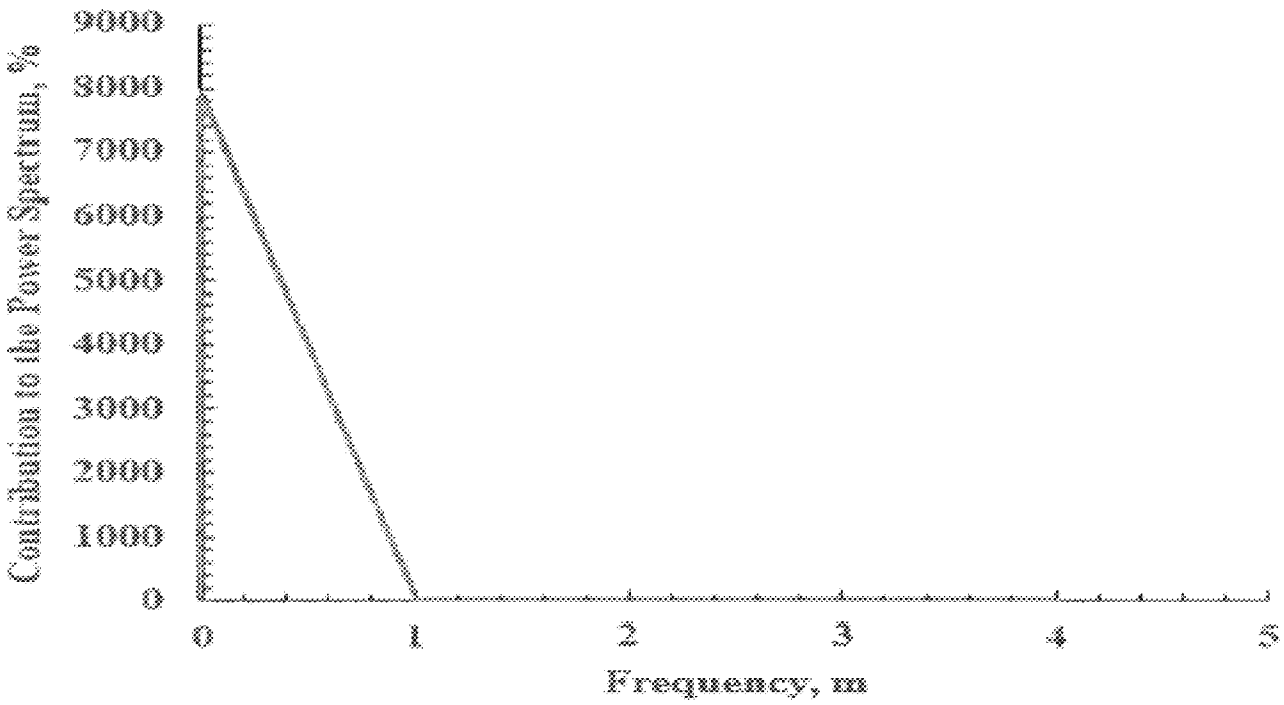
FIG. 12 is a Fourier power spectrum for the redox potential ("Eh") of the "cold water" fracturing fluid.
Figure 13:
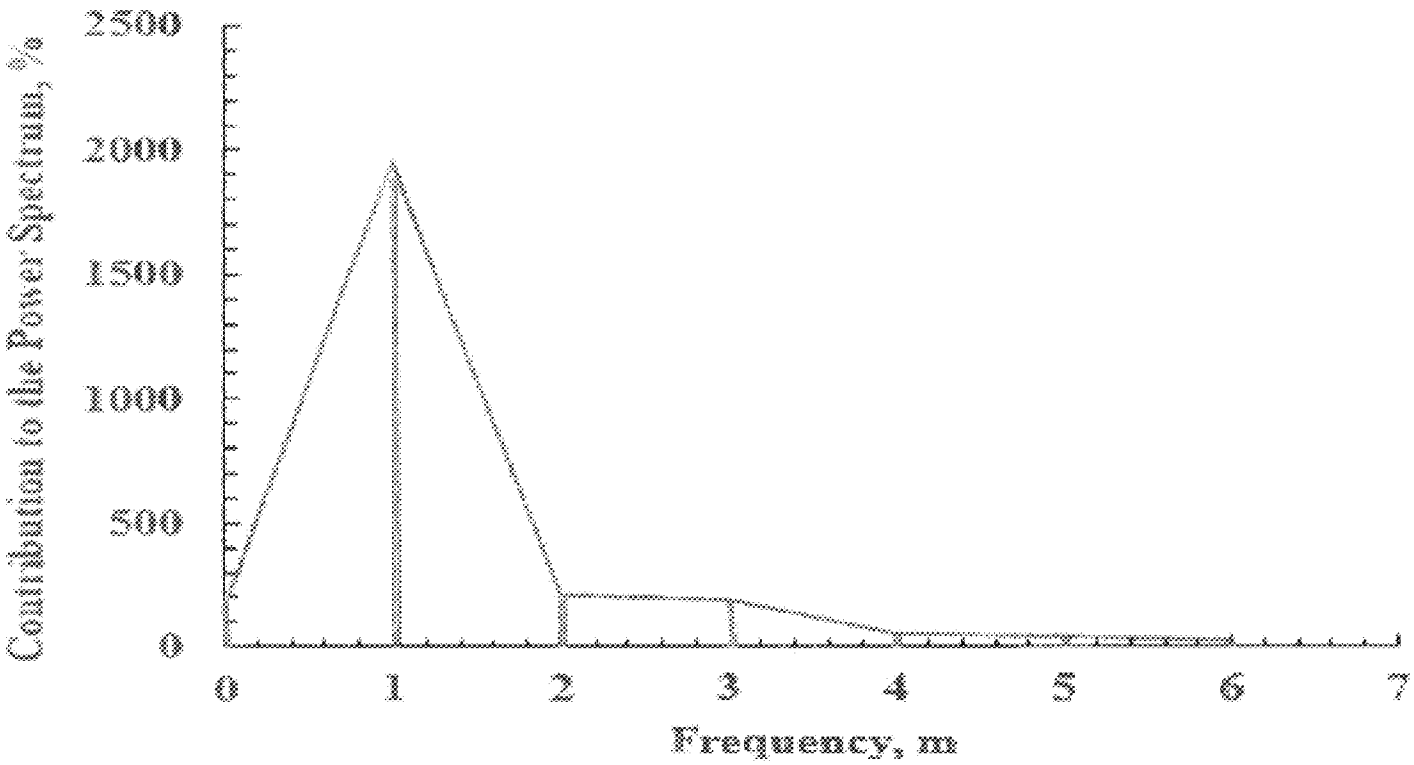
FIG. 13 is a Fourier power spectrum for the redox potential ("Eh") of the heated fracturing fluid.

FIGS. 12 and 13 demonstrate the Fourier power spectrums for the ambient temperature fracturing liquid and a fracturing liquid that hand been heated by 10 degrees Fahrenheit, respectfully. These Figures, along with the Diffusion coefficients seen in FIGS. 8 and 9, demonstrate an ability to better estimate the shale pore sizes than the current practice of classifying them in the general form of "macro-pore", "meso-pore", and "micro-pore."

With the above considerations in mind, the user can enhance oil and gas production of the tight reservoirs by generating micro-fractures in the shale through heating. The cause of the micro-fractures is the differential thermal conductivities of dissimilar mineral contents of the shale (e.g. clay fraction thermal conductivity is approximately 1.0

W/m-K, but chert or quartz thermal conductivity is approximately 3 W/m-K). It should be noted that the differences in thermal conductivities do not have to be significantly different.

Oil and gas production from tight reservoirs can further be enhanced by generating micro-fractures through cycling low-quality steam (semi-wet steam) injected at two different temperatures, which is shown in FIGS. 2, 3, 4, and 5. The cyclic temperature, steam quality, and exposure time (number of cycles) similar to the hammering process generates tremendous amounts of variations in the compression and tensile properties of the shale.

Total failure and splitting of the shale occurs at a frequency of approximately 900 to 1000 Hertz. When shale material is heated, it will vibrate at a certain frequency until it fractures or breaks apart. Determining the point at which shale breaks apart sets the limits of cycling frequency of wet steam at which the micro-fractures are generated and the frequencies at which the rock breaks apart.

The described features, advantages, and characteristics may be combined in any suitable manner in one or more embodiments. One skilled in the relevant art will recognize that the varying components of this design may be practiced without one or more of the specific features or advantages of the particular embodiment. In other instances, additional features and advantages may be recognized in certain embodiments that may not be present in all embodiments.

We claim:

1. A method for enhancing the production of hydrocarbons during hydraulic fracturing of shale reservoirs, comprising:

(a) Performing a thermal survey of a drilled well by:
  1. measuring the temperature, thermal conductivity and heat transfer inside of the well using a geothermal conductivity measuring device;
  2. using the measurements of thermal conductivity and heat transfer to identify one or more potential zones; and
  3. marking said potential zones;

(b) generating a heat spectrum of each of the one or more potential zones identified in said drilled well;

(c) measuring the temperature, exposure time, amplitude and vibration frequency of each potential zone during the application of steam;

(d) cycling an application of semi-wet steams to one of the potential zones in order to generate variation in the compression and tensile properties of the shale, wherein at least two of the semi-wet steams have different temperatures.

2. The method of claim 1, wherein the thermal survey is conducted while the well is being drilled.

3. The method of claim 1, wherein said method is performed prior to said hydraulic fracturing of shale reservoirs.

4. The method of claim 1, wherein the measurements of the one or more potential zones during the application of said steam, and the generation of that steam are controlled by a programmable logic controller.

* * * * *